United States Patent [19]

Finley

[11] Patent Number: 4,928,962

[45] Date of Patent: May 29, 1990

[54] GRIP ENHANCED FOOTBALL

[76] Inventor: Charles O. Finley, 155 North Michigan Avenue, Chicago, Ill. 60601

[21] Appl. No.: 404,663

[22] Filed: Sep. 8, 1989

[51] Int. Cl.[5] ..... A63B 41/08

[52] U.S. Cl. ..... 273/65 E G; 40/327

[58] Field of Search ..... 273/65 E G, 65 E, 65 E D, 273/65 E E, 65 E F, 232; 40/327; D21/204, 205

[56] References Cited

U.S. PATENT DOCUMENTS

| | | | |
|---|---|---|---|
| 933,110 | 9/1909 | Rempes | 273/65 E G |
| 1,377,283 | 5/1921 | Schenuit | 273/65 E G |
| 4,000,894 | 1/1977 | Butzen | 273/232 |
| 4,318,544 | 3/1982 | Brine | 273/65 E G |
| 4,570,931 | 2/1986 | Martin | 273/65 E G |
| 4,804,189 | 2/1989 | Gobush | 273/232 |
| 4,813,677 | 3/1989 | Oka et al. | 273/232 |
| 4,830,378 | 5/1989 | Aoyama | 273/232 |

OTHER PUBLICATIONS

Photographs labeled "A" and "B" showing a conventional football having a grain formed of pebble-like projections or blisters on the exterior surface.

Photographs labeled "C" and "D" showing a football having the recessed grain design developed by the Horween Leather Company of Chicago, Illinois.

*Primary Examiner*—George J. Marlo

*Attorney, Agent, or Firm*—Neuman, Williams, Anderson & Olson

[57] ABSTRACT

A grip enhanced football is disclosed which includes a plurality of recesses on the exterior surface of the ball separated from one another by a network of interconnected ridges. Each recess has a polygonal open side at the exterior surface of the ball and a wall converging from the open side to a bottom wall. Each ridge in the network has a narrow outer surface. The enhanced grip allows the ball to be thrown, punted and placed-kicked more accurately and for longer distance.

5 Claims, 1 Drawing Sheet

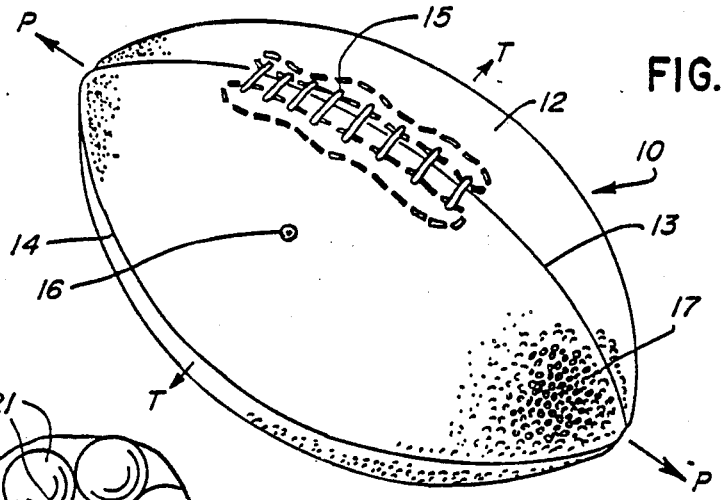
FIG. 1
FIG. 2
PRIOR ART
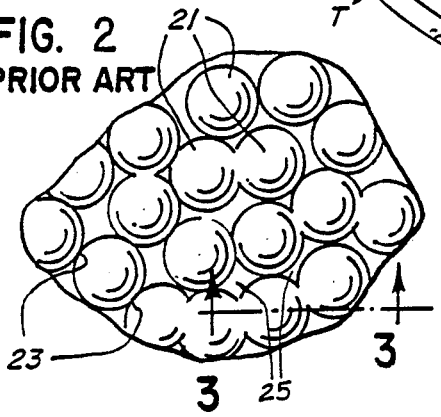
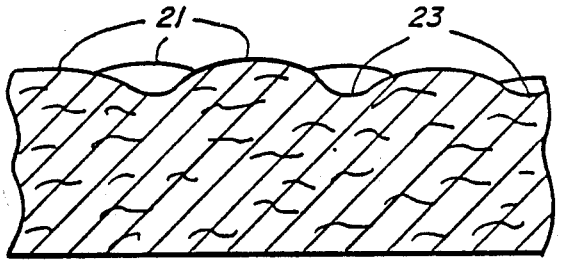
FIG. 3
PRIOR ART
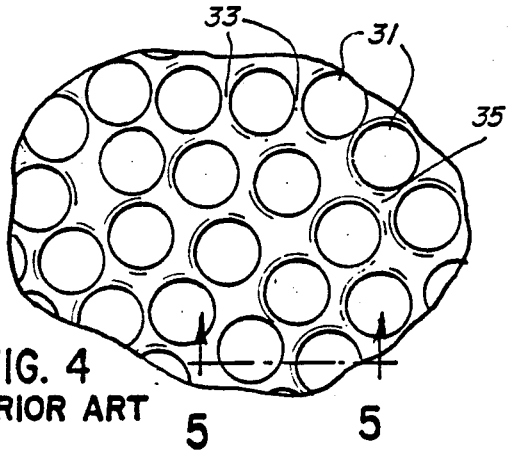
FIG. 4
PRIOR ART
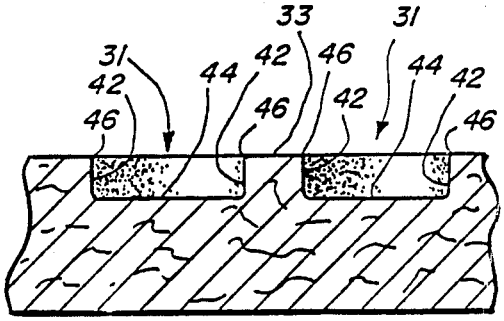
FIG. 5
PRIOR ART
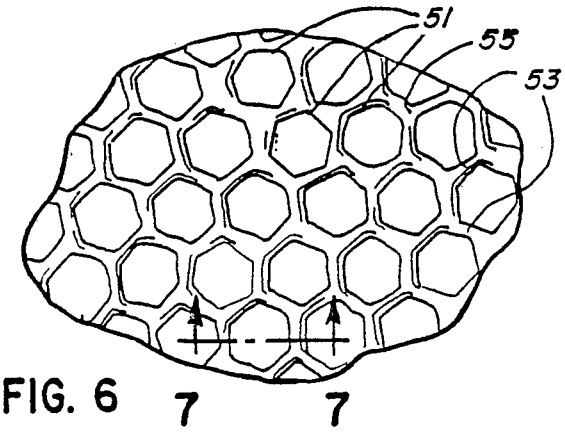
FIG. 6
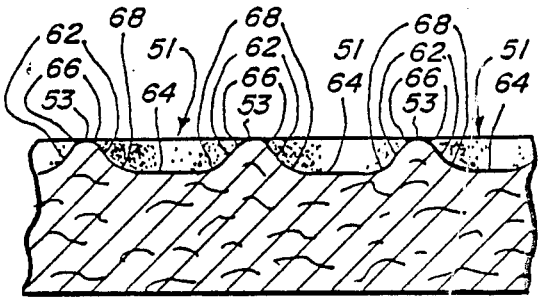
FIG. 7

GRIP ENHANCED FOOTBALL

BACKGROUND OF THE INVENTION

1. Field Of The Invention

The present invention relates to footballs, and more particularly to a substantially firmer grip enhanced football provided with contoured recesses on the exterior surface of the ball.

2. Background Of The Invention

Applicant Charles 0. Finley is a widely regarded sports figure who has introduced pioneering advancements to professional sports. As the former owner of the Oakland Athletics baseball club for twenty years, applicant made substantial contributions to the game of baseball. His Oakland A's baseball team won five straight Division Championships (1971–75) and three straight World Championships (1972–74). Applicant also introduced the designated hitter rule and the playing of World Series and All-Star games at night. In addition, applicant introduced colorful uniforms and white shoes to the game of baseball to replace the prison gray uniforms and black shoes previously worn by players. Applicant's sports interests extend beyond the game of baseball. While simultaneously pursuing his baseball interests, applicant owned a professional hockey club, the California Golden Seals of the National Hockey League, and a professional basketball club, the Memphis Tams of the American Basketball Association, which merged in 1977 with the National Basketball Association.

In the late 1960s, as the owner of the Oakland Athletics baseball club, applicant introduced "The Alert Orange Baseball" to the game of baseball. The Alert Orange Baseball had two principal advantages over conventional white baseballs: (1) fans could follow the flight of an orange ball more easily than a white ball, and (2) the batter could more easily see an orange ball being delivered at a speed of 90–100 miles per hour out of the white background of a pitcher's uniform. In exhibition games, fans reacted in an overwhelmingly positive manner to the Alert Orange Baseball. Umpires also attested to the benefits of the Alert Orange Baseball, stating that the ball was not only easier to see from behind the plate, but gave rise to a greater number of hits and fewer fielding errors in exhibition games in which the orange baseball was used.

More recently, applicant introduced a Visually Enhanced Football, which is described and claimed in applicant's copending Application Ser. No. 07/359,140, filed May 31, 1989, now U.S. Pat. No. 4,867,452. The Visually Enhanced Football has a visually enhancing design applied to the exterior surface of the ball. The design generally circumscribes the longitudinal extent of the football so that upon rotation about the longitudinal axis a first distinctive visual image is produced and upon rotation about a transverse axis a second distinctive visual image is produced. The visually enhancing design does not protrude substantially from the surface of the ball and does not affect the normal flight and gripping of the ball.

In various sports, such as football, the gripping and tactile characteristics of the ball can make a considerable difference in the performance of the participating players. This is especially true in football where grip affects the players' ability to throw the ball accurately and for distance, and also affects the players' ability to maintain possession of the ball while running or preparing to punt or place-kick the ball. In addition, football games are oftentimes played out-of-doors and in unpredictable weather conditions including rain, snow and other conditions affecting the players' ability to grip the ball. It is therefore desirable to provide a football having enhanced gripping and tactile characteristics to improve the performance of the players while simultaneously avoiding the imposition of features or structures on the surface of the ball that would disrupt the flight of the ball. Similarly, it is desirable to enhance the gripping of a football while retaining the traditional tactile characteristics or "feel" associated with conventional footballs.

Unlike round sport balls, the prolate spheroidal shape of a football requires the development of special skills to throw, punt and place-kick the ball. When throwing the football as a spiral pass, the ball must be gripped so that it can be thrown overhand in the direction of the longitudinal axis of the ball while simultaneously spinning the ball about its longitudinal axis. When thrown as a lateral pass, the football is gripped so that the ball can be thrown underhand in the direction of a transverse axis while simultaneously spinning the ball about its longitudinal axis. When punted, the ball is dropped from the punter's hands onto the kicking foot, and once punted, may either rotate in a spiral about the longitudinal axis or rotate end-over-end about a transverse axis. When place-kicked, the ball is either kicked from a tee, as in a kick-off, or kicked while being held by another player, as in a field goal or extra point attempt. A place-kicked ball generally rotates end-over-end about a transverse axis.

Clearly it would be to the thrower's advantage to be able to more readily grip the ball and to more accurately execute spiral and lateral passes over longer distances. Likewise, it would be to the advantage of receivers and ball carriers to more readily grip the ball and maintain firm possession of the ball while being pursued or tackled by opposing players. Similarly, it would be to the punter's advantage to more readily grip the ball after delivery from the center and while executing the punt. It would also be to the place-kick holder's advantage to more readily grip the ball after delivery from the center and while positioning the ball for the place-kicker to execute a field goal or extra point attempt. For these reasons and also to enhance the spectators' enjoyment of the game because of the improved performance of the players, it is desirable to provide a football with enhanced gripping and tactile characteristics without affecting the normal flight or aerodynamic behavior of the ball.

The exterior surface of conventional footballs has a grain formed of pebble-like projections or blisters on the exterior surface. These pebble-like projections are convex, rounded and generally hemispherical in shape, with each projection separated from its neighboring projection by recessed bands or valleys. The valleys are much narrower in width than the average diameter of the projections, and form a substantially continuous, interconnected network over the surface of the ball. The junctures or intersections at which the valleys converge are also much narrower than the average diameter of the projections.

In conventional footballs having exterior surfaces made of leather, the pebble-like grain is embossed onto the leather by applying pressure using a suitable stamping device. In footballs having synthetic, non-leather exterior surfaces, the pebble-like grain is applied during injection or compression molding of the surface piece, or, alternatively, embossed using heat and/or pressure.

Regardless of the technique used to apply the grain to conventional footballs, the resulting pebble-like projections provide enhanced gripping characteristics as compared to balls having smooth exterior surfaces. In particular, a player's fingers and palm will conform to the grain of the ball such that the skin will compress against the pebble-like projections but remain uncompressed or less compressed with respect to the valleys surrounding the projections. Enhanced gripping of the football results from the frictional interaction between the projections and skin of the player's hand. This interaction is distinct from and in addition to the enhanced gripping provided by the lacing of the ball.

Several years ago, a football was proposed which had a reverse grain pattern consisting of substantially circular recesses formed on the exterior surface of the ball. The recesses of the prior design were formed with orthogonal walls extending inwardly from the exterior surface of the ball and ending at a substantially flat bottom portion. In the prior design, each recess was separated from its neighboring recesses by a raised portion that formed a substantially continuous network over the surface of the ball. However, the raised portions of the prior design were much wider than the valleys surrounding the pebble-like projections of conventional footballs, especially at the junctures of three or more recesses. Moreover, these raised portions were occasionally wider than the average diameter of the recesses.

The orthogonal walls defining the recesses in the prior reverse grain design formed a sharp circular lip at their intersection with the exterior surface of the ball. The sharp circular lips prevented a player's hand from conforming comfortably to the recesses of the prior design when throwing or receiving the ball. The circular periphery of the recesses and substantial width of the raised portions in the prior design also allowed for a fewer number of recesses across the surface of the ball. Moreover, the sharpness of the circular lips defining the recesses create discomfort when the ball was gripped for throwing or when the ball was received when thrown. The prior reverse grain football was therefore less tactically appealing than conventional footballs.

OBJECTS OF THE INVENTION

An object of the invention to provide a grip enhanced football that improves the ability of players to throw, punt and place-kick the ball.

A further object of the invention is to provide a grip enhanced football that avoids the imposition of features or structures on the surface of the ball that disrupt the flight of the ball.

A still further object of the invention is to provide a grip enhanced football that is comfortable when gripped and does not supplant the traditional tactile characteristics associated with conventional footballs.

Other objects, advantages and features of the invention will become apparent upon reading the following detailed description and appended claims, and upon reference to the accompanying drawings.

SUMMARY OF THE INVENTION

These and other objects are achieved by a grip enhanced football comprising a plurality of laterally spaced recesses on the exterior surface of the ball. Each recess has a polygonal open outer side and a wall converging from the open side towards a closed bottom wall. The football also comprises a network of interconnected ridges separating adjacent recesses. Each ridge in cross section has a narrow outer surface, sides diverging from the outer surface, and rounded segments interconnecting the outer surface to the sides. An intaglio pattern on the exterior surface of the ball cover is thereby obtained.

BRIEF DESCRIPTION OF THE DRAWINGS

For a more complete understanding of the invention, reference should now be made to the embodiments illustrated in greater detail in the accompanying drawings and described below by way of example only. In the drawings:

FIG. 1 is perspective view of a football having a grain pattern on its exterior surface for grip enhancement;

FIG. 2 is a fragmentary, enlarged plan view of a conventional, prior art football having pebble-like projections on its exterior surface;

FIG. 3 is a fragmentary, enlarged sectional view taken along line 3—3 of FIG. 2;

FIG. 4 is similar to FIG. 2 but showing the exterior surface of a prior reverse grain football;

FIG. 5 is a fragmentary, enlarged sectional view taken along line 5—5 of FIG. 4;

FIG. 6 is a fragmentary, enlarged plan view of the exterior surface of one embodiment of the improved grip enhanced football;

FIG. 7 is a fragmentary, enlarged sectional view taken along line 7—7 of FIG. 6.

DETAILED DESCRIPTION OF THE DRAWINGS

Turning now to FIG. 1, a football 10 of the form and shape conventionally used in the game of football is illustrated. Football 10 is prolate spheroidal in shape and preferably comprises an inflatable bladder (not shown) enclosed in a cover 12 made of leather or synthetic sheet material and normally having four panels joined at or delineated by longitudinal seams 13 and 14. As used herein, the longitudinal direction is parallel to principal axis P—P of ball 10 in FIG. 1. A transverse axis T—T is also illustrated in FIG. 1. The bladder is inserted through a gap in seam 13. Subsequent to insertion of the bladder within the cover, the gap is closed by lacing 15 which is typically of a contrasting color to the cover 12. Ball 10 is inflated by the introduction of pressurized air into the bladder through valve 16. The exterior surface of cover 12 is provided with a grain pattern 17 for grip enhancement.

FIGS. 2 and 3 illustrate one embodiment of the exterior surface of a conventional, prior art football having a grain pattern formed of pebble-like projections or embossments 21 on the exterior surface. Projections 21 in this embodiment are convex, rounded and generally hemispherical in shape. Each projection is separated from its neighboring projection by recessed bands or valleys 23. Valleys 23 are much narrower in width than the average diameter of projections 21, and form a substantially continuous, interconnected network over the surface of the ball. The junctures 25 at which valleys 23 converge or intersect are also much narrower in width than the average diameter of the projections.

When gripping the conventional football of the type shown in FIGS. 2 and 3, a player's fingers and palm will conform to the grain contour of the ball such that the skin of the player's hand will compress against projections 21 but remain uncompressed or less compressed with respect to valleys 23 and junctures 25. Enhanced gripping of the football results from the frictional interaction between projections 21 and the skin of the player's grasping hand. This interaction is distinct from and in addition to the enhanced gripping provided by the interaction of the player's fingers and the lacing on the ball.

FIGS. 4 and 5 illustrate the exterior surface of a prior reverse grain football. The surface configuration in the illustrated embodiment closely resembles that incorporated in the aforementioned reverse grain football. As shown in FIG. 4, the exterior surface of the prior design consists of substantially circular recesses 31 separated from one another by raised portions 33 which form a substantially continuous network over the exterior surface of the ball. In the prior design, adjacent raised portions 33 are much wider than valleys 23 of the conventional football illustrated in FIGS. 2 and 3, and intersect one another at junctures 35. The circular periphery of recesses 31 and substantial width of raised portions 33 and junctures 35 allow for a fewer number of recesses to be formed on the exterior surface of the ball.

As shown in FIG. 5, recesses 31 are formed with orthogonal walls 42 extending transversely inwardly from the exterior surface of the ball and ending at a substantially flat bottom portion 44. Orthogonal walls 42 form sharp circular lips or edges 46 at the intersection with the exterior surface of the ball, thus preventing a player's hand from conforming comfortably to the exterior surface of the ball. Moreover, the sharpness of circular lips 46 creates discomfort when firmly gripped or received, and the ball is therefore tactically unappealing compared to conventional footballs such as the one illustrated in FIGS. 2 and 3.

FIGS. 6 and 7 illustrate an exterior surface portion of one embodiment of the improved grip enhanced football. The exterior surface comprises a plurality of laterally spaced, crater-like recesses 51, each having a polygonal periphery. In the preferred embodiment, each recess 51 has a substantially hexagonal periphery and is separated from adjacent recesses by raised portions or ridges 53. Ridges 53 converge or intersect at enlarged junctures 55 located between three recesses 53, as shown in FIG. 6. An intaglio pattern on the exterior surface of the ball is thereby obtained.

In order to obtain ridges 53 having a minimum width and thereby enable a maximum number of recesses to be formed on the exterior surface of the ball, each recess 51 has a polygonal open outer surface. Such a polygonal shape allows adjacent recesses to be in close proximity to one another and the width of the outer surface of ridges 53 to be very narrow. As used herein, the width of a raised portion or ridge is the minimum distance between the open sides of two adjacent recesses. The width of the raised juncture 55 is the greater of the minimum distances between the open sides of adjacent recesses proximate the juncture.

As shown in FIG. 7, the inwardly extending side walls 62 defining a recess 51 converge from the top surface of the adjacent ridge 53 towards an inner closed bottom wall 64. The segments 66 between walls 62 and the top surface of ridges 53 are rounded, as seen more clearly in FIG. 7, thereby enabling the player to more comfortably grip the exterior surface of the ball. The width of the outer surface of each ridge 53 is substantially less than the maximum diametrical dimension of the open outer side of an adjacent recess 51.

When gripping the improved grip enhanced football shown in FIGS. 6 and 7, a player's fingers and palm will conform to the surface contour of the ball such that the skin of the player's hand will compress against ridges 53 and junctures 55 while simultaneously forcing the air out of the recesses 51 covered by the player's hand. The rounded segments 66 of the contoured recesses allow the skin to comfortably engage recesses 51, ridges 53 and junctures 55, thus forming a seal at the outer sides of the recesses engaged by the player's hand. Gripping results primarily from the frictional interaction between the skin of the player's hand and side walls 62 of recesses 51, ridges 53, and junctures 55. However, it is believed that gripping is further enhanced at least in part from the displacement of air from recesses 51 beneath the player's hand and the sealing off of the open sides of underlying recesses 51, thereby creating a slight vacuum or negative pressure that tends to retain the ball against the skin. The grip enhanced football illustrated in FIGS. 6 and 7 also retains the traditional tactile characteristics and "feel" associated with conventional footballs. In this regard, the surface pattern of the improved grip enhanced football has recesses and ridges that are similar in number and size to the pebble-like projections of a conventional football.

The grain pattern illustrated in FIGS. 6 and 7 improves the players' ability to grip the ball, thereby allowing players to throw the ball more accurately and for greater distance. The presence of the contoured recesses on the surface of the ball does not significantly disrupt the flight of the ball. In fact, it is believed that the presence of contoured recesses imparts aerodynamic characteristics to the ball in a manner similar to the dimples on a golf ball. In other words, the contoured recesses may in optimal cases allow the ball to be thrown, punted or place-kicked in a more controlled trajectory and for greater distance than conventional balls with the pebble-like projections or the aforementioned reverse grain design.

It will be understood that since the shape of a football is prolate spheroidal, a polygonal shape, such as a hexagon on the surface of the ball, is not a true polygon with straight sides. Rather, the sides of the polygon curve over the prolate spheroidal surface along arcs of circles or ellipses. As used herein, planar terms such as "polygon", "hexagon", "parallel", and "flat" surfaces refer to the projection of the three-dimensional surface onto a planar surface.

The grip enhancements of the present invention can be readily combined with the visual enhancements described and claimed in copending Application Ser. No. 07/359,140, filed May 31, 1989, now U.S. Pat. No. 4,867,452, and incorporated herein by reference. Such a combination would provide a Grip And Visually Enhanced Football.

From the foregoing it will be seen that a football is provided that is grip enhanced to improve the performance of players generally. The enhanced grip will allow the ball to be thrown more accurately and for substantially longer distance. The grip enhanced football is particularly suitable for use in inclement weather conditions such as rain, snow and other conditions affecting the player's ability to grip the ball.

While particular embodiments have been set forth herein, other equivalent grip enhancements to prolate spheroidal sports balls would achieve similar results.

Alternative embodiments and various modifications will also be apparent to persons skilled in the art from the above description. These and other equivalent alternatives are considered within the spirit and scope of the invention.

What is claimed is:

1. A grip enhanced prolate spheroidal football comprising a plurality of laterally spaced recesses formed on an exterior thereof, each recess having a substantially polygonal open outer side and a wall converging from the open outer side towards a closed bottom wall, and a network of interconnected ridges separating adjacent recesses, each ridge in cross section having a narrow outer surface, sides diverging from the outer surface, and rounded segments interconnecting the outer surface to the sides.

2. The grip enhanced football of claim 1 wherein the open outer side of each recess has a substantially hexagonal configuration.

3. The grip enhanced football of claim 1 wherein the outer surface of each ridge has a width substantially less than the diametrical dimension of an outer open side of an adjacent recess.

4. The grip enhanced football of claim 1 wherein the recesses and the network of interconnected ridges are located substantially throughout the exterior surface of the ball.

5. A grip enhanced prolate spheroidal football comprising a cover having an exterior surface provided with an intaglio pattern, said pattern including a plurality of laterally spaced recesses, each of said recesses having a substantially crater-like configuration with converging side walls, and a network of interconnected ridges separating adjacent recesses, each ridge in cross section having a narrow outer surface, sides diverging from the outer surface, and rounded segments interconnecting the outer surface to the sides.

* * * * *